US005782306A

United States Patent [19]

Serafin

[11] Patent Number: 5,782,306

[45] Date of Patent: Jul. 21, 1998

[54] OPEN HOLE STRADDLE SYSTEM

[75] Inventor: Vitold P. Serafin, Calgary, Canada

[73] Assignee: Site Oil Tools, Inc., Alberta, Canada

[21] Appl. No.: 572,003

[22] Filed: Dec. 14, 1995

[51] Int. Cl.[6] ..... E21B 33/127

[52] U.S. Cl. ..... 166/387; 166/187; 166/188

[58] Field of Search ..... 166/187, 188, 166/191, 387, 126, 129, 133

[56] References Cited

U.S. PATENT DOCUMENTS

| | | | |
|---|---|---|---|
| Re. 32,345 | 2/1987 | Wood . | |
| 2,218,155 | 10/1940 | Rusler et al. . | |
| 2,227,729 | 1/1941 | Lynes . | |
| 2,227,730 | 1/1941 | Lynes . | |
| 2,399,125 | 4/1946 | Lehnhard, Jr. . | |
| 3,291,219 | 12/1966 | Nutter . | |
| 3,422,673 | 1/1969 | Lebourg . | |
| 3,908,769 | 9/1975 | Schuyf et al. . | |
| 3,948,322 | 4/1976 | Baker . | |
| 4,445,027 | 4/1984 | Sado . | |
| 4,648,448 | 3/1987 | Sanford et al. . | |
| 4,934,460 | 6/1990 | Coronado . | |
| 5,291,947 | 3/1994 | Stracke | 166/187 |
| 5,316,081 | 5/1994 | Baski et al. . | |
| 5,383,520 | 1/1995 | Tucker . | |

FOREIGN PATENT DOCUMENTS

| | | |
|---|---|---|
| 972678 | 8/1975 | Canada . |

OTHER PUBLICATIONS

Tam–J Heavy–Duty Inflatable Packers for Well Testing, Workovers, and Production —Undated.

Solving Horizontal Well Problems with TAM Inflatable Zone–Isolation Systems —Undated.

The Proven Solution to Costly Isolation Problems, Vertical to Horizontal —Undated.

Annulus Casing Packer (ACP) —McAllister —Undated.

Inflatable Systems —Baker Oil Tools —Undated.

Baski Inflatable Packers —BIP —Jul. 4, 1994.

*Primary Examiner*—William P. Neuder

*Attorney, Agent, or Firm*—Oliff & Berridge

[57] ABSTRACT

A set of inflatable well packing elements are separated by a variable length of tubing and are set in a well to isolate a segment of the annulus by applying fluid under pressure through a tubing string to the well packing elements. The flow of the fluid under pressure to the inflatable packing elements is regulated by a flow control valve which automatically cuts off the fluid flow at a predetermined tubing to annulus pressure differential and opens communication between the tubing string and the isolated well zone. Fluid may thereafter be pumped into or swabbed from the isolated zone. Upon completing the zone servicing, pulling the tubing string up slightly will both equalize the pressure across the inflatable packing elements, and deflate the packing elements. Thereafter, the tubing string may be retrieved from the well or, if desired, moved to another location which can be serviced in the same manner.

13 Claims, 6 Drawing Sheets

OPEN HOLE STRADDLE SYSTEM

BACKGROUND OF THE INVENTION a. Field of the Invention

The present invention relates to down hole isolation apparatus and method for well treatment and/or testing, and more particularly to an apparatus and method that uses a set of inflatable type well packers straddled with a variable length of tubing string and having an integral flow control valve.

b. Description of the Prior Art

Well packers utilized for isolating a segment of an oil well bore for performing a well-servicing operation are known. For this purpose, it is known to run a set of packers down-hole to a selected position and to set the packers using fluid under pressure applied through the tubing string. After setting, the fluid is sealed in the packing elements to maintain a seal between these and the well bore, and a path is opened from the tubing string and the segment isolated between the packing elements to allow work on the formation. Once the work has been completed, the pressure is equalized across the packing elements, the packing elements are then deflated, and the tool reset to be positioned over another segment of the well bore, or retrieved to the surface.

In one specific currently available packer of this type, a steel ball is circulated down through the tubing to the straddle assembly and lands in a choke where it cuts off the flow through the assembly. Applying pressure through the tubing inflates the packing elements, isolating a section of the well bore from the zones above and below the packing elements. Setting down-string weight onto the assembly locks the packers in the set position, allowing the ball to pass through the choke and opening a channel to the formation. Picking up the work string will unset the packers, and if desired, the packers may be moved to another position in the well to treat a different interval by repeating the procedure.

In another specific currently available packer (see U.S. Pat. No. 5,383,520 Tucker et al.), two inflatable-type well packers in the straddle assembly are run down-hole on tubing to the desired position. The assembly includes a dynamic flow control valve which is spring biased to the open position and through which fluid may be circulated to the annulus while the tool is being run into the hole. When the tool is at the desired position in the well bore, the fluid pressure is increased to overcome the spring force and move the flow control valve to its closed condition thereby redirecting the pressurized fluid from the tubing string to inflate the packing elements, thus isolating the section of the well bore from the zones above and below the packing elements. Once the packers are inflated, the tubing string has to be reciprocated to achieve the various required functions. Setting down-weight onto the assembly reciprocates a J-slot mechanism which locks the packers in the set position. Subsequently, pulling up on the string reciprocates the J-slot into the next position, opening a channel to the formation. Setting down-string weight onto the assembly again reciprocates the J-slot to a third position in which the packers deflate. Picking up string weight will reciprocate the J-slot back to its original position, allowing the tool to be moved to a new location and reset.

Generally, these systems do not require work string rotation, making them suitable for horizontal wells where string rotation is not possible. Tool strings using this type of set up have worked well in the past. However, the service crew must pay close attention to ensure the packers are not over-inflated. To inflate both packers generally requires a communication line between the two. Since the line is exposed there is danger it may be broken. Circulating balls to plug the tubing or running tools on a wireline, although generally not difficult, are extra complications and may limit the number of times a system is reset. Valves that rely on controlling the flow rate to shift them are limited in that if the flow rate changes, reverses or is stopped all together, the valve will shift back to its original position. Finally, in horizontal wells, friction between the work string and the well bore will limit the weight that can be set onto the straddle assembly, which weight may be necessary to open a path to the formation. Because most downhole tools of this type require string movement or weight to operate, wells with very long horizontal sections cannot be tested with such systems.

SUMMARY OF THE INVENTION

The present invention attempts to overcome the above-noted problems by providing a unique method and apparatus for selectively isolating and treating a well bore interval, that operates solely on pressure applied at the surface.

Specifically, the present invention provides a method of setting a pair of axially spaced well packers in a well bore for isolating therebetween a segment of such well bore, comprising (a) running the pair of packers on a tubing string to a selected position in the well bore; (b) inflating packing elements of said packers into sealing engagement with the well bore by supplying fluid under pressure thereto through the tubing string; (c) setting said packers by automatically sealing the packing elements in inflated condition in response to a preset pressure condition being reached; and (d) thereafter automatically opening a fluid path from the tubing string to the segment of well bore isolated between the packing elements.

From another aspect, the invention provides a removable packer device for isolating a segment of a well bore comprising: (a) a housing for attachment to a tubing string, said housing carrying a pair of axially spaced inflatable packing elements; (b) a first fluid path through said housing for delivering fluid under pressure from the tubing string to the inflatable packing elements to cause them to expand and sealingly engage with the well bore to isolate the segment of the well bore that lies between the packing elements; (c) a first valve controlling said first fluid path; (d) a pressure responsive sensor coupled to actuate said first valve for automatically sealing said inflatable packing elements after the latter have been inflated to a pressure sufficient to ensure their sealing engagement with the well bore, said first valve when so actuated opening a second fluid path from the tubing string to the isolated segment of the well bore; and (e) an actuator in said housing selectively operable to close said second fluid path and to open a third fluid path through said housing to equalize pressure in the isolated well bore segment with the adjacent regions of the well bore above and below the packing elements, said actuator being coupled for operation in response to a short axial movement of said tubing string.

The actuator is preferably also operable to equalize pressure between the inflatable packing elements and the surrounding well bore allowing the packing elements to be deflated so that the tool can be retrieved or moved to a different location in the well bore.

The pressure responsive sensor is preferably mounted for exposure to a first force that corresponds to the pressure differential between the interior of the tubing string and the well bore, and to a second force of predetermined magnitude (e.g. a spring) to activate the first valve when the first force overcomes the second force. For example it may include a piston slideable within the device and controlling passages in the first and second fluid paths.

The disclosed method and apparatus is effective for establishing communication between the tubing (work) string and the isolated interval is established without: work string movement (other than the last movement being down), string weight slacked-off onto the apparatus, tension pulled into the work string, work string rotation, extraneous equipment (e.g., steel balls, hydrostatic fluid control valves, etc.), wireline or slickline operations or controlling the fluid flow rate from the surface.

The present invention operates independently of the hydrostatic fluid pressure in the well and actuates automatically at a pre-set tubing-annulus pressure differential, at any desired downhole location. Upon establishing communication between the work string and the formation, the device remains actuated regardless of pressure or fluid flow changes in the well. Thereafter, simply lifting the work string equalizes the pressure differential across the system, deflates the packing elements and resets the device so it may be retrieved from the well or, if desired, moved to another location which may be treated in the same manner.

The preferred embodiment of the device has a set of upper and lower inflatable type packers for sealingly engaging a well bore (both having tubular mandrels that extend therethrough) separated by a variable length of tubing string which defines a port therein through which fluids can be pumped into or swabbed from the formation when the packing means are set, and further comprising an integral flow control valve and flow cross-over. The flow control valve comprises:

(a) a valve sleeve connectable to the work string and moveable therewith for: sealingly engaging the upper packer while inflating the upper and lower packing elements; pumping or swabbing fluid into or from the formation; and for equalizing the pressure differential across the assembly, deflating the packers and reinitializing the apparatus when the work string is pulled upwardly;

(b) a tubular mandrel that extends therethrough and is connected to the upper packer and the tubular mandrel thereof, and forms a seal inside the valve sleeve, the valve sleeve being axially moveable on the mandrel;

(c) a plunger sealingly engaging the inside of the tubular mandrel for directing fluid flow inside or around the mandrel and relatively moveable therewith;

(d) a piston with return spring, the piston being moveable relative to the tubular mandrel, and forming a seal therewith and being actuated by pressure applied from the surface;

(e) a connector disposed in the mandrel adapted so the piston controls movement of the plunger and;

(f) a valve housing adapted to allow fluid to flow therethrough to which the tubular mandrel and said upper packing means are connected and sealingly engaging the piston, the piston being relatively moveable inside the valve housing, the valve housing also sealingly engaging the valve sleeve, the valve sleeve being relatively moveable therewith.

The flow cross-over further comprises an inner sleeve adapted to direct the fluid flow from the flow control valve either to the lower packing element or to the formation, depending on the status of the flow control valve. Upon applying pressure to the Inside of the work string the flow control valve In conjunction with the flow cross-over, at a pre-set tubing-annulus pressure differential automatically redirects fluid flow from the lower packing element to the formation without:

(i) rotating the work string, (ii) setting weight onto the apparatus, (iii) moving the work string (other than the last movement being down), (iv) pulling tension into the work string, (v) using any extraneous equipment, wireline or slickline operations, or (vi) controlling the fluid flow rate.

As noted the flow control valve actuates automatically and independently of the hydrostatic fluid pressure in the well, and it remains actuated regardless of pressure or fluid flow rate changes in the well.

These and other advantages will become more apparent from the illustrative drawings when taken in conjunction with the preferred embodiment of the invention given by way of example only.

DESCRIPTION OF THE PREFERRED EMBODIMENT

Figures 1A, 1B, 1C:
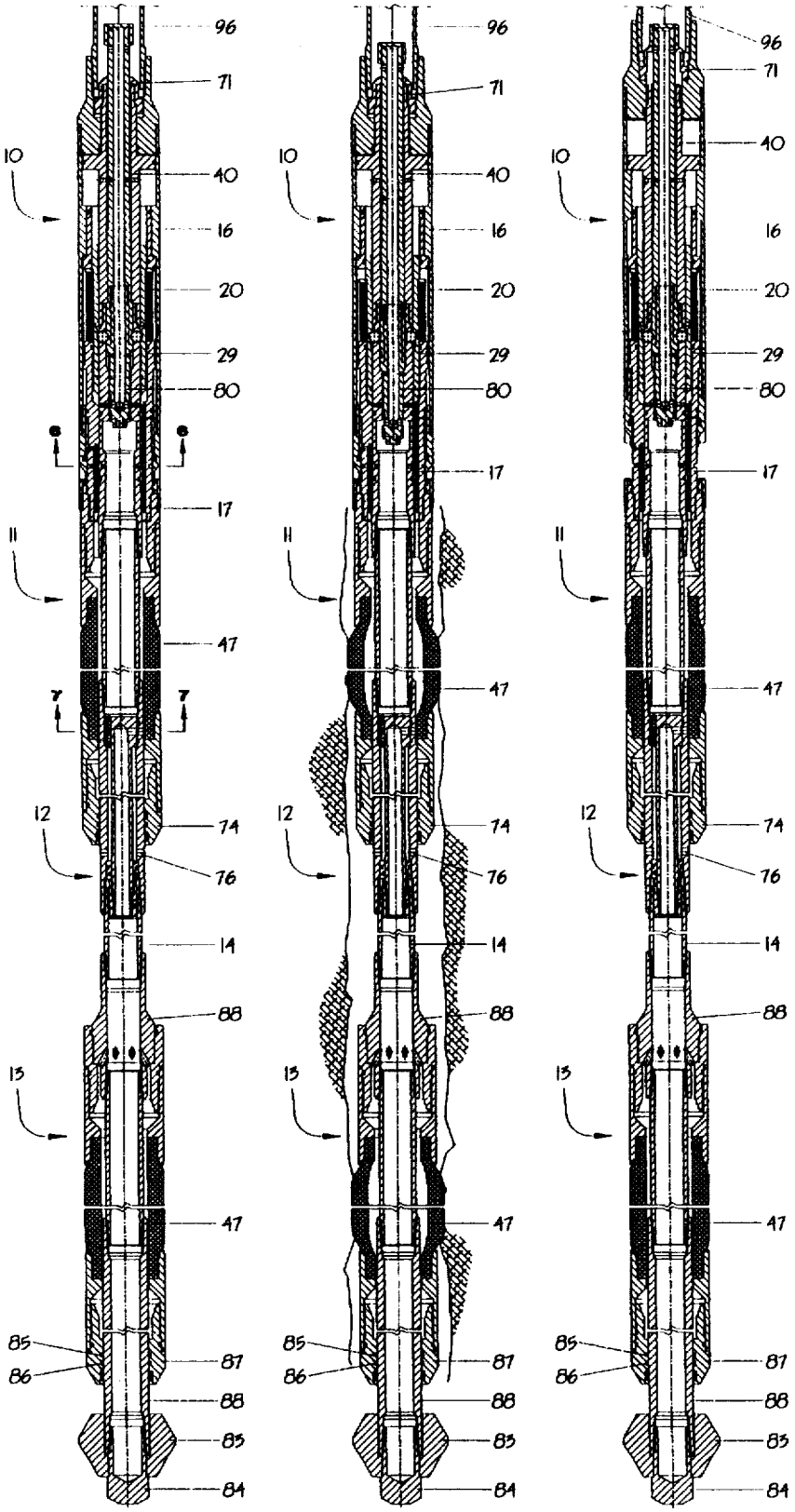
FIGS. 1(*a*)–1(*c*) show a longitudinal section of one embodiment of the present invention, showing a set of inflatable type packers, a flow control valve and a flow cross-over being lowered into a well or inflating the packing elements, during well treatment or testing, and being retrieved from the well respectively.

Referring to FIG. 1 the tool is shown in its entirety (a) as it would be run into the well, or during inflating the packers, (b) injecting or swabbing fluid into or from the formation, and (c) as it would be retrieved from the well. The main components of the tool string generally designated 15 are the flow control valve 10, the flow cross-over 12 and the upper and lower inflatable packers 11 and 13. The invention is not limited to any particular inflatable packers and may be adapted for use with other such than that shown. Although FIG. 1(*b*) is referred to as the injecting position, fluid may be swabbed (removed) from or injected into the formation . When referring to the injecting position therein It is understood that this can mean either injecting or swabbing.

Figure 2:
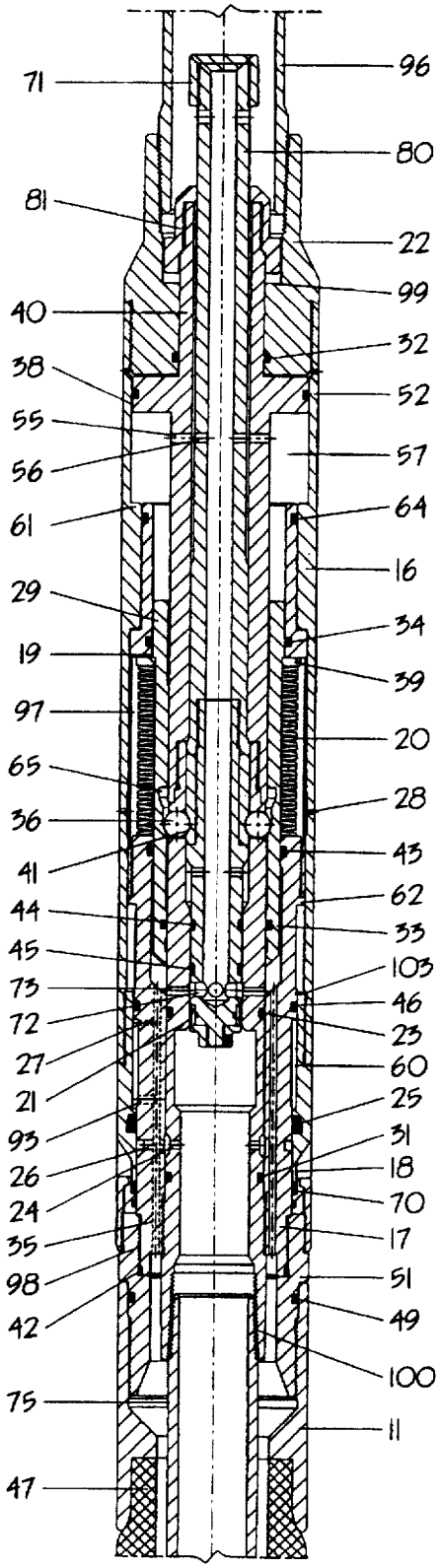
FIG. 2 is a longitudinal section of the flow control valve shown as it would be positioned when run into a well or inflating the packing means.

The flow control valve 10 has at its upper end a valve sleeve 16 which is connected to the tubing or work string 96 and is therefore moveable with work string 96. Referring to FIG. 2, knife sub 18 at the lower end of valve sleeve 16 engages with knife seal 70 on valve housing 17. Sealing unit 25, also near the lower end of valve sleeve 16, seals on valve housing 17 when flow control valve 10 is in the inflating or Injecting positions as shown in FIGS. 1(*a*) and 2. Holes 28 drilled in valve sleeve 16 allow fluid from the well bore to enter a chamber 97 thus defining a relatively low pressure area. O-rings 34, 43, 46 and 64 provide sealing engagement between valve housing 17, valve sleeve 16, and piston 29, preventing the annular fluid from reaching the formation and inflatable packing means 11 and 13 when the apparatus 15 is in the inflating or injecting positions.

Return spring 20 consists of a number of belleville springs (but can conceivably also be a coil spring) and pushes against stop ring 39 and valve housing 17. Stop ring 39 rests on shoulder 19 of piston 29. In the inflating or equalizing positions, return spring 20 is generally uncompressed and forces piston 29 into a relatively higher position with respect to valve housing 17 and valve mandrel 40. (FIGS. 1(*a*) and 2).

Valve housing 17 and connecting sub 51 are attached at threaded connection 98 and are relatively immovable with each other. Upper packer 11 attaches to connecting sub 51 with o-ring 42 providing a seal to prevent pressure from bleeding off when inflating packing elements 47. Connecting sub 51 threads to valve housing 17 preventing relative movement between valve mandrel 40 and upper packer 11, with o-ring 31 providing a seal between valve mandrel 40 and valve housing 17. Axial ports 35 in valve housing 17 allow fluid flow through valve housing 17 to the upper packer 11. Radial ports 27 allow communication from the work string 96 to pressure chamber 60 defined by o-ring 46 and sealing unit 25. Equalizing ports 26 allow communication between the well bore and the upper and lower packer 11 and 13 during equalizing and releasing.

Figure 3:
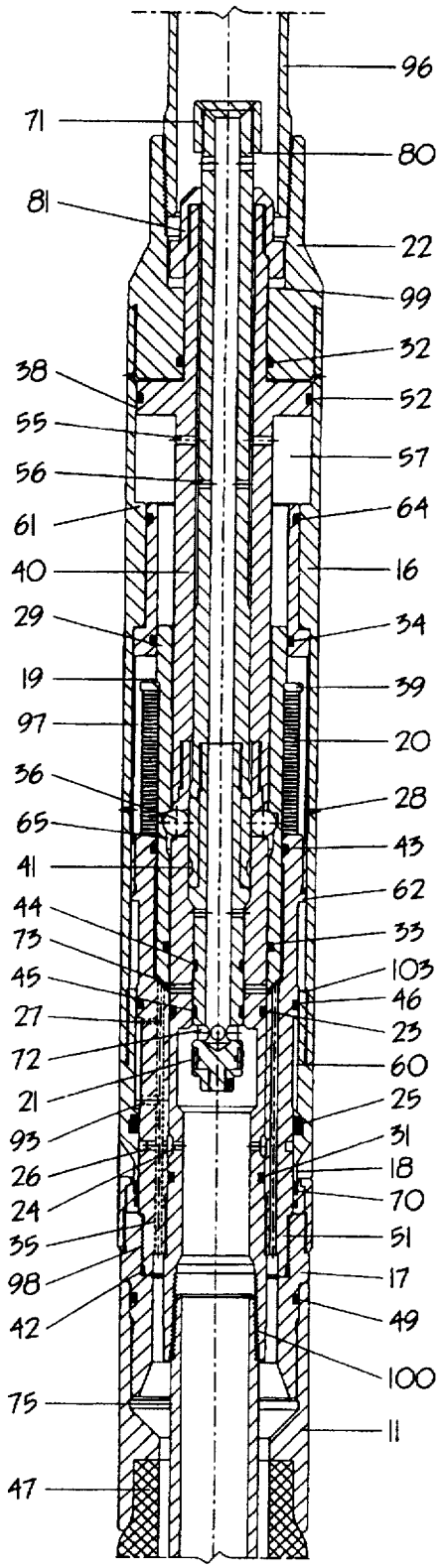
FIG. 3 is a longitudinal section of the flow control valve as it would be positioned during well treatment or testing.

Disposed inside valve mandrel 40 is tubular plunger 80 which is relatively moveable therewith. Radial ports 55 and 56 in plunger 80 and valve mandrel 40 respectively, allow fluid flow to pressure chamber 57 defined by o-ring 52 in valve mandrel 40 which seals inside valve sleeve 16, o-ring 33 in piston 29 which seals on valve mandrel 40, o-ring 64 in valve housing 17 which seals in valve sleeve 16 and o-ring 34 inside valve housing 17 which seals on piston 29. A number of steel balls 36 are housed in valve mandrel 40, each of which rest inside an annular recess 65 in piston 29 and in pocket 41 in plunger 80. As can be seen in FIG. 3, annular recess 65 allows steel balls 36 to move radially outward when piston 29 actuates. Radial ports 72 and 73 in plunger 80 and valve housing 17 respectively, allow fluid flow through communication ports 35 to upper and lower packing means 11 and 13 when piston 29 is relaxed. Sealing unit 21 and o-ring 31 prevent fluid from flowing through spacing joint 75. When piston 29 actuates, o-rings 44 and 45 prevent pressure from bleeding out of upper and lower packing means 11 and 13. Collar 81 floats on plunger 80 and engages cap 71 at the top of plunger 80 and shoulder 99 inside top coupling 22 during equalizing and retrieving.

Figure 4:
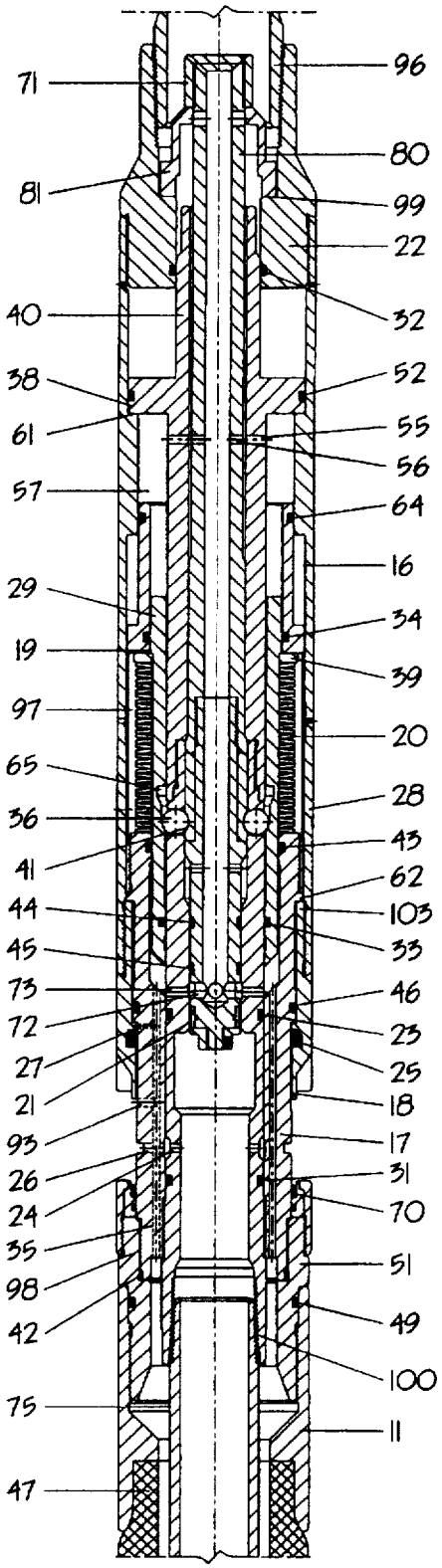
FIG. 4 shows a longitudinal section of the flow control valve as it would be positioned being retrieved from a well.
Figure 5:
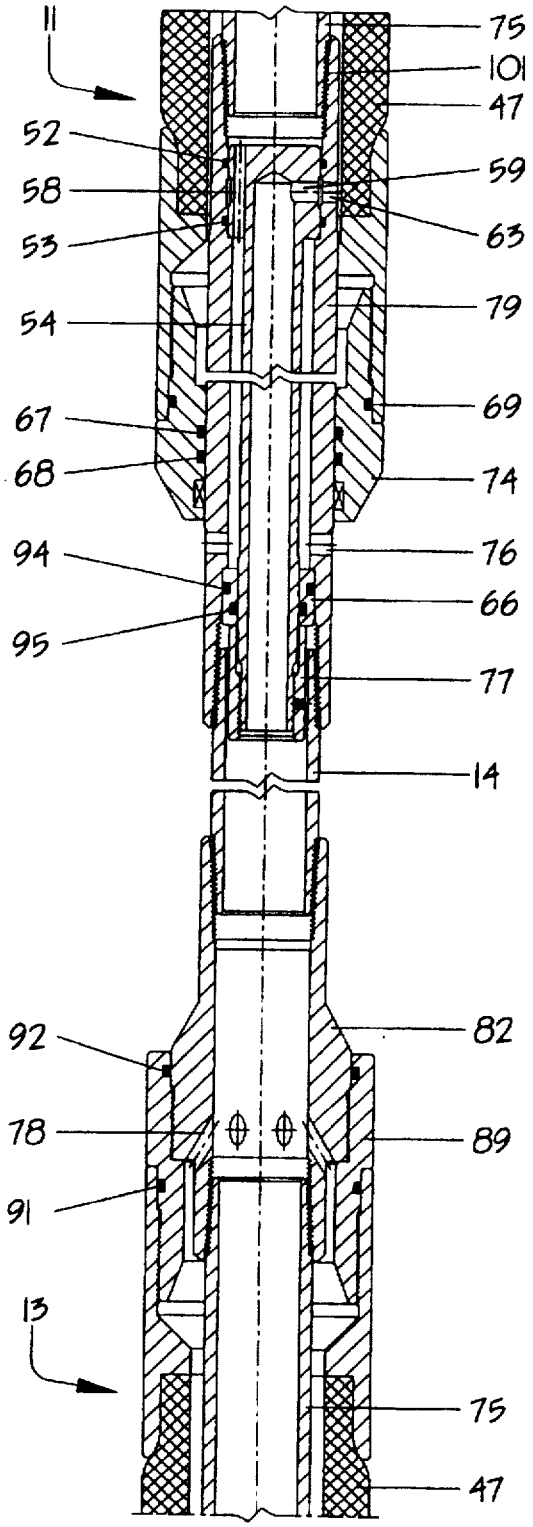
FIG. 5 shows a longitudinal section of the flow cross-over.

Referring now to FIGS. 4 and 5, spacing joint 75 of upper packing means 11 attaches to valve mandrel 40 of fluid control valve 10 by threaded connection 100 and to upper packer mandrel 79 by threaded connection 101. Seal sub 74 at the bottom of upper packing means 11 can float freely over upper packer mandrel 79 with o-rings 67 and 68 providing a seal. Axial ports 58 in cross-over sleeve 54 allow communication between the inside of spacing joint 75 and the annular space between cross-over sleeve 54 and upper packer mandrel 79. Radial ports 76 connect the annular space between cross-over sleeve 54 and upper packer mandrel 79 with the formation interval defined by upper and lower packing means 11 and 13. Radial ports 59 and 63 in cross-over sleeve 54 and upper packer mandrel 79 respectively, allow fluid to flow from the annular space between packing element 47 and upper packer mandrel 79 to the inside of cross-over sleeve 54 and down through spacing joint 14 of variable length to lower packing means 13. O-rings 94 and 95 on seal unit 66 seal the annular space between upper packer mandrel 79 and cross-over sleeve 54 from the inside of spacing joint 14.

Referring to FIGS. 1 and 4, lower packing means 13 consists of spacing joint 75 and lower packer mandrel 88, with drag assembly 83 and plug 84 at the bottom of lower packer mandrel 88. Drag assembly 83 engages with the well bore to provide the necessary friction to allow relative movement between the valve sleeve 16 and the various mandrels to actuate the apparatus 15. Ports 78 in coupling 82 allow communication between spacing joint 14 and the annular space between spacing joint 75 and lower packer mandrel 88 and packing element 47. Connecting sub 89 attaches to coupling 82 and upper element retainer 102 with o-rings 91 and 92 effectively sealing the inside of lower packing means 13 from the isolated formation interval. Seal sub 87 is free to move on lower packer mandrel 88 with o-rings 85 and 86 preventing communication between the well bore and the inside of lower packing means 13.

OPERATION OF THE INVENTION

The components of apparatus 15 are positioned as shown in FIGS. 1(*a*) and FIG. 2, generally designated as the inflating position, as the apparatus is run into the well bore. Drag assembly 83 engages with the well bore to provide enough friction so work string 96 can push valve sleeve 16 into the position shown in FIG. 2. In this position, knife sub 18 engages with knife seal 70 and valve sleeve 16 stops against connecting sub 51. Because valve housing 17 attaches to connecting sub 51, valve mandrel 40 and spacer joint 75 of upper packing means 11, the entire assembly 15 will move down the well bore as shown in FIG. 1(*a*). The engagement of knife sub 18 and knife seal 70 along with sealing unit 25 in valve housing 16 effectively seals communication between work string 96 (through radial ports 24 and 26 in the valve mandrel 40 and valve housing 17 respectively) and the well bore.

As seen clearly in FIG. 2, plunger 80 is disposed in a relatively higher position with respect to valve mandrel 40 and radial ports 72 are lined up with radial ports 73 in valve housing 17 allowing communication through axial ports 35 between work string 96 and upper packer 11. Referring to FIG. 5, there is an open path through radial ports 63 and 59 in upper packer mandrel 79 and cross-over sleeve 54 respectively, through spacing joint 14 and finally through communication ports 78 in coupling 82 to lower packer 13 (FIGS. 2 and 5). With an unobstructed path from work string 96 to both upper and lower packers 11 and 13, and a positive seal preventing communication between the well bore and work string 96, fluid may flow into upper and lower packers 11 and 13. Pressure applied at the surface to the inside of tubing string 96 will inflate packer elements 47 causing them to expand and seal against the well bore, isolating the interval between them from the zone above tool string 15 and the zone below.

One advantage the present invention has over prior art tools is that if, for any reason, packers 11 and 13 are prematurely inflated (by a pressure surge in the well for instance), simply pulling work string 96 upwardly will release the built up pressure in the packers. Drag assembly 83 provides the necessary friction to allow relative movement between work string 96, valve sleeve 16 and valve housing 17. Knife sub 18 disengages from knife seal 70 allowing the built up pressure to escape through radial ports 26 and 93 in valve housing 17 to the well bore, effectively equalizing the pressure across the tool string 15 (FIG. 4). Thereafter, lowering work string 96 will re-engage knife sub 18 and knife seal 70 and the tool string can continue to the desired location and packers 11 and 13 can be inflated as described.

As can be seen in FIG. 2, steel balls 36 prevent plunger 80 from moving and are trapped in annular recess 65 in piston 29 and in pocket 41 of the plunger. Sealing unit 21 and o-rings 45 provide a seal on either side of radial ports 73, and since plunger 80 is solid at the bottom, fluid can only flow through radial ports 72 and 73. O-ring 33 inside piston 29 seals on valve mandrel 40 and o-rings 34 and 43 in valve housing 17 form a seal on piston 29. Radial ports 55 and 56 in valve mandrel 40 and plunger 80 along with radial ports 73 in valve housing 17 permit pressure to accumulate on either side of piston 29 as pumping continues. A relatively low pressure chamber 97 defined by o-rings 34, 43, 46 and 64 within which return spring 20 is situated, is open to the well bore by means of holes 28 in valve sleeve 16. Because the diameter on which o-ring 34 seals to piston 29 is slightly larger than that on which o-ring 43 seals and the pressure in chamber 97 is lower than that in work string 96, a pressure differential builds across piston 29. As pumping continues, the pressure differential will become great enough to overcome the force exerted on piston 29 by return spring 20 and move piston 29 downward.

Figure 6:
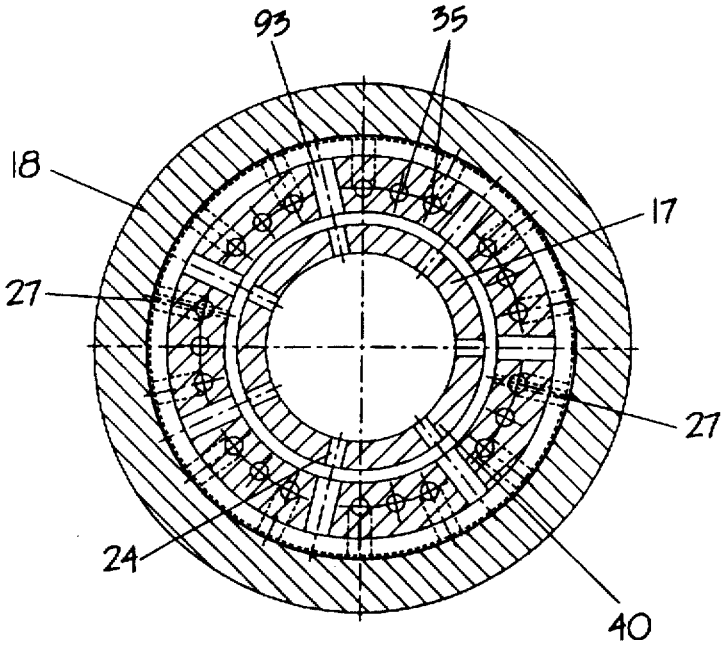
FIG. 6 shows a cross section taken along lines 6—6 in FIG. 1(*a*)
Figure 7:
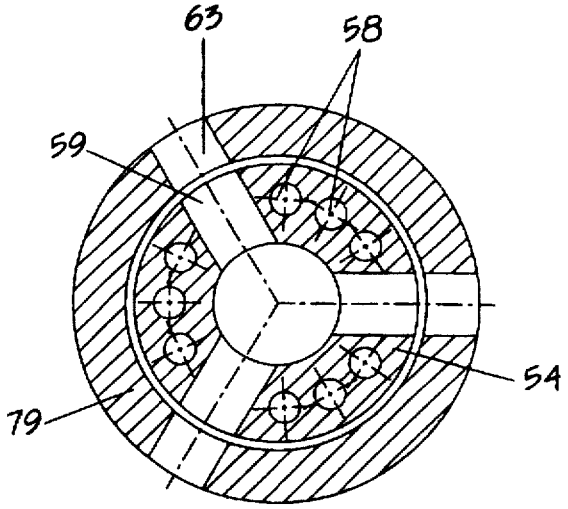
FIG. 7 shows a cross section taken along lines 7—7 in FIG. 1(*a*).

Since the pressure inside plunger 80 is greater than that inside valve housing 17, a pressure differential also builds across the plugged lower portion of plunger 80. Once piston 29 has moved sufficiently downward to position the upper portion of annular recess 65 over steel balls 36, steel balls 36 may move radially outward. The pressure differential across the plugged lower portion of plunger 80 creates sufficient force to move the plunger down until o-rings 44 and 45 are on either side of radial ports 73. Sealing unit 21 disengages from the inside of valve mandrel 40 exposing radial ports 72 to the inside of valve housing 17 as shown in FIG. 3. A relatively high pressure chamber 60 defined by o-ring 46 and sealing unit 25, is open to work string 96 by ports 24, 26, 27 and 93 (see FIG. 6). Pressure in chamber 60 applies a force on valve sleeve 16 in the downward direction to further push knife sub 18 into engagement with knife seal 70. With return spring 20 in a generally compressed condition, it generates a force on steel balls 36 radially inward onto plunger 80 sufficient to hold the plunger in the position shown in FIG. 3. In this position, steel balls 36 prevent piston 29 from moving upward and lock flow control valve 10 in the injecting position.

Thus delivery of pressurized fluid from the work string 96 through the plunger 80, the aligned radial ports 72, 73, and the axial ports 35 in the valve housing 17 is cut off when the piston 19 is moved downwardly allowing the balls 36 to move outwardly into the annular recesses 65 in the piston, thus freeing the plunger 80 to move downwardly and cut off communication between the radial ports 72 and 73. As explained, such downwards movement of the piston 29 is in response to the differential pressure which acts thereacross namely the downwards force generated by pressure in the chamber 57 acting on the upper end of the piston 29 less the upwards force generated by the pressure acting on the lower end of the piston 29 via the radial ports 72, 73 less the combined effects of the force of the return spring 20 and the pressure within the chamber 97 (which corresponds to the pressure within the well bore) acting upwardly on the shoulder 19 of the piston. Since the area of the shoulder 19 is the same as the difference in areas between the upper and lower ends of the piston 29, the resultant forces acting on the piston are a downwards force corresponding to the pressure differential between the interior of the work string 96 and the well bore, and an upwards force corresponding to the force of the spring 20. The magnitude of the differential force is thus determined by the strength of the return spring 20 so that the inflation pressure of the packers 11 and 13 is in effect adjusted automatically to take account of the localised pressure within the well bore so that the packers always achieve an adequate but not excessive degree of inflation. Thus, it will be understood that the piston 29 functions as a pressure responsive sensor to actuate the flow control valve 10 to seal the packing elements 47 after they have been inflated to the required pressure.

As seen in FIG. 5, fluid may now flow from the radial ports 72 in the plunger 80, through spacer joint 75, through axial ports 58 in cross-over sleeve 54, into the annular space between upper packer mandrel 79 and cross-over sleeve 54, out through ports 76 and into the annular port defined by upper and lower packers 11 and 13. Continued pumping action will inject fluid into the formation without over-inflating packing elements 47. Conversely, fluid may be swabbed from the formation without deflating packing elements 47.

As described, packers 11 and 13 are inflated and a passage is opened to the isolated well bore interval without any work string rotation or movement (other than the last movement being down). The entire operation is accomplished by applying pressure to the inside of tubing string 96 from the surface. Since return spring 20 has a known spring coefficient, as noted above the flow control valve 10 can be set (by suitable selection of the spring coefficient) to actuate at a pre-determined pressure differential ensuring that packers 11 and 13 are not over-inflated. Hydrostatic pressure or flow rate through flow control valve 10 will have no effect on the operation of the valve 10. Steel balls 36 ensure that flow control valve 10 remains actuated whether fluid is pumped into or out of the formation. As well, no other equipment is required to actuate the system. It is clear there are many advantages over prior art tools, especially in horizontal wells where rotating the work string is not possible, string weight is limited and running extra equipment downhole is difficult.

When the zone treatment or testing is finished, pulling upward on tubing string 96 will release the tool string 15. This action simultaneously accomplishes several tasks. First, because of any pumping or swabbing action there is a pressure differential across tool string 15 which has to be equalized before it is released. Otherwise, if the tool string is pushed up or down within the well, damaging of the packing elements 47 may result. Second, packing elements 47 must be deflated; again to avoid damaging them. Finally, flow control valve 10 must be reset to a position as that in FIG. 2 so the apparatus may be used again without the need to pull the tubing string and apparatus from the well.

With reference to FIG. 4, when tubing string 96 is pulled upwardly by a small amount, valve sleeve 16 moves along with it and knife sub 18 disengages from knife seal 70. Equalizing ports 26 are thus opened to the well bore, equalizing any pressure differential between tool string 15 and the well bore. Slight additional upwards movement of the tubing string 96 and valve sleeve 16 opens the radial relief ports 93 to the well bore so that pressure in upper and lower packers 11 and 13 escapes into the well bore, deflating them to their original size. Simultaneously, a shoulder 99 inside the top coupling 22 picks up a collar 81 and carries it upwards with tubing string 96. Collar 81 engages a cap 71 on the top of plunger 80 lifting plunger 80 up with the work string 96.

When the plunger 18 has been raised sufficiently to bring the pockets 41 into register with the steel balls 36, the latter move radially inwardly into the pockets thus releasing from the piston 29. The pressure across the piston 29 now being equalized (both ends of the piston and the shoulder surface 19 now being exposed to the pressure of the well bore) the return spring 20 acts to push the piston upwardly to Its original position as shown in FIG. 4 (corresponding to the position shown in FIG. 2) wherein its annular recess 65 is above the steel balls 36 so that the latter are held in engagement with the plunger 80.

In the final range of upward movement of the valve sleeve 16, a shoulder 61 thereon engages a stop or abutment 38 on the valve mandrel 40 at the same time as a shoulder 103 at the upper end of the knife sub 18 lifts a shoulder 62 on the valve housing 17 thus pulling the entire tool string 15 upward as shown in FIG. 1(*c*). The tool string may now be retrieved from the well or, if desired, moved to another location where another interval can be treated by repeating the aforementioned procedures. In doing this the tool is reset by a final downwards movement so that the drag assembly 83 pushes the valve sleeve 16 to the position shown in FIG. 2, as described above.

It is clear, therefore that the flow control valve of the present invention is well adapted to carry out the ends and advantages mentioned as well as those inherent therein. While a preferred embodiment has been shown for the purposes of this disclosure, numerous changes may be made by those skilled in the art. All such changes are encompassed within the scope and spirit of the appended claims.

I claim:

1. A removable packer device for isolating a segment of a well bore comprising:

(a) a housing for attachment to a tubing string, said housing carrying a pair of axially spaced inflatable packing elements;

(b) a first fluid path through said housing for delivering fluid under pressure from the tubing string to the inflatable packing elements to cause them to expand and sealingly engage with the well bore to isolate the segment of the well bore that lies between the packing elements;

(c) a first valve controlling said first fluid path;

(d) a pressure responsive sensor coupled to actuate said first valve for automatically sealing said inflatable packing elements after the latter have been inflated to a pressure sufficient to ensure their sealing engagement with the well bore, said first valve when so actuated opening a second fluid path from the tubing string to the isolated segment of the well bore; and (e) an actuator in said housing selectively operable to close said second fluid path and to open a third fluid path through said housing to equalize pressure in the isolated well bore segment with the adjacent regions of the well bore above and below the packing elements, said actuator being coupled for operation in response to a short axial movement of said tubing string.

2. A packer device as claimed in claim 1 wherein said actuator is further operable to equalize pressure between said inflatable packing elements and the well bore, allowing the packing elements to deflate.

3. A packing device as claimed in claim 1 wherein said pressure responsive-sensor is mounted for exposure to a first force corresponding to the differential in pressure between the interior of the tubing string and the well bore, and to a second force of preset magnitude, to activate said first valve when said first force overcomes said second force.

4. A packer device as claimed in claim 1 wherein said pressure responsive sensor comprises a piston one end of which is exposed in one axial direction to a force that is a function of the differential in the fluid pressure within said drill string and the fluid pressure in the well bore, at the exterior of said device, and in the opposite axial direction to a spring loading force of preset magnitude, such that said piston is movable in response to said pressure differential reaching a predetermined level to displace said piston to move said first valve to a position to close said first fluid path and seal said inflatable packing elements.

5. A packer device as claimed in claim 1 wherein said housing comprises:

a valve sleeve that is attachable to the tubing string;

a tubular mandrel coaxially surrounded by said valve sleeve, said tubular mandrel extend therethrough and having a lower end which provides a support for said packing elements; and a tubular valve housing coaxially arranged between a portion of said valve sleeve and a portion of said tubular mandrel, said valve housing being fixed with respect to said tubular mandrel, and said valve sleeve being in sealing engagement with said valve housing and axially movable relative thereto;

a plunger being arranged coaxially within the tubular mandrel and axially movable in sliding engagement relative thereto;

a disengageable connector selectively actuable to engage the mandrel to the plunger to prevent relative axial movement thereof, or to free the plunger for axial movement relative to the mandrel;

said pressure responsive sensor comprising a coaxial piston located between and in sliding engagement with respect to said valve sleeve said valve housing and said mandrel, a first annular chamber defined between said valve sleeve and said mandrel in communication with one end of said piston;

a second annular chamber defined between said mandrel and said valve housing in communication with the opposite end of said piston, said first chamber having a cross-sectional area that is greater than the cross-sectional area of the second chamber;

a third annular chamber defined between an intermediate part of the piston and the valve sleeve, within said third chamber the piston defining an annular shoulder having a cross-sectional area equal to the difference between the cross-sectional areas of the piston that are exposed to said first and second annular chambers;

an axially directed compression spring mounted to act between one end of said third chamber and the annular shoulder of the piston;

openings in said valve sleeve exposing said third chamber to ambient pressure;

first pairs of pressure ports in said plunger and said mandrel respectively which can be aligned to expose said second chamber to pressure within the tubing string through said mandrel;

second pairs of radial ports in said mandrel and said plunger which can be aligned to communicate the pressure in the interior of said mandrel with the pressure in said first annular chamber, said second pair of ports constituting a part of said first fluid path, said first fluid path further including axially extending passages in said valve housing communicating from said first annular chamber to the packing elements of said inflatable packers;

said plunger having one limiting axial position relative to said mandrel wherein said first and second pairs of ports are respectively in register, said plunger being retained in said first limiting position by said disengageable connector;

said disengageable connector being coupled to said piston to be actuated thereby upon axial displacement of said piston in response to said differential pressure of a predetermined magnitude thus freeing the plunger for movement axially from said first limiting position to a second limiting position wherein said first and second pairs of ports are moved out of alignment so that said first and second annular chambers are sealed thus preventing movement of said piston, in said second limiting position the interior of said plunger communicating with the interior of a tubular connector that is positioned between and interconnects said packers, there being openings in said tubular connector whereby its interior is exposed to pressure conditions in the well bore between said packers, movement of the plunger to the second limiting position thereof causing opening said second fluid path;

said second valve comprising radial equalization ports communicating the hollow interior of said mandrel with the external surface of said valve housing at a location wherein they are normally sealed by the lower portion of said valve sleeve, upwards displacement of said valve sleeve forming a communication through the tool between the well bore segment that is isolated by the packers, the well bore above the upper packer and the pressure within the tubing string.

6. A packer device as claimed in claim 5 wherein said second valve is also operable to equalize pressure between said inflatable packing elements and the well bore, for which purpose it includes relief ports extending from the external surface of said valve housing and communicating with longitudinal passages leading to the interior of the inflatable packing elements, said relief ports being spaced axially above said equalization ports to be uncovered by sequential upwards movement of the valve sleeve beyond the location where the equalizing ports are uncovered.

7. A packer device as claimed in claim 6 including an abutment surface on said valve sleeve and positioned to engage said plunger and move it axially upwards in response to upwards movement of the valve sleeve, the upwards movement of the plunger being sufficient to actuate said connector to reestablish a connection between said plunger and said mandrel and also to move the interior of said plunger out of communication with the hollow interior of the hollow connector.

8. A packer device as claimed in claim 7 wherein said mandrel includes a collar that is engageable with a shoulder on said valve sleeve to be carried upwardly thereby on upwards movement of the valve sleeves;

downwards movement of said tubing string being effective to move said valve sleeve downwardly to close off said radial ports and relief ports and to reestablish said first fluid path through said housing.

9. A method of setting a pair of axially spaced well packers in a well bore for isolating therebetween a segment of such well bore, comprising:

(a) running the pair of packers on a tubing string to a selected position in the well bore;

(b) inflating packing elements of said packers into sealing engagement with the well bore by supplying fluid under pressure thereto through the tubing string;

(c) setting said packers by automatically locking the packing elements in sealed inflated condition in response to a preset pressure condition being reached, such that said packing elements remain locked in sealing engagement with said well bore irrespective of subsequent changes in pressure conditions in said well bore and in said tubing string; and (d) thereafter automatically opening a fluid path from the tubing string to the segment of the well bore isolated between the packing elements.

10. The method of claim 9 wherein the said steps (a) through (d) are accomplished without manipulating the tubing string, controlling the fluid flow rate, or using extraneous equipment.

11. The method of claim 10 wherein said fluid path of step (d) is maintained in the open condition during use, and is subsequently closed by short axially upwards movement of the tubing string.

12. A method for setting, removing and resetting a pair of axially spaced packers for isolating a segment of well bore therebetween, comprising:

(a) running the pair of packers on a tubing string to a selected position in the well bore;

(b) inflating packing elements of said packers into sealing engagement with the well bore by supplying fluid under pressure thereto through the tubing string;

(c) setting the packers by automatically sealing the packing elements in inflated condition in response to a preset pressure condition being reached;

(d) automatically opening a path from the tubing string to the segment of well bore isolated between the packing elements;

(e) for removal of the packers, subsequently equalizing the pressure across the packing elements by opening a fluid path between the isolated bore segment and an adjacent region of the bore beyond the packing elements;

(f) automatically deflating the packing elements by releasing pressurized fluid contained therein; and (g) resetting the packers by repeating steps (a) to (d) above.

13. The method of claim 12 wherein said steps (a) to (d) are accomplished without: manipulating the tubing string, controlling the fluid flow rate, or using extraneous equipment; said steps (e) and (f) being accomplished as the result of a short axially upwards movement of said tubing string.

* * * * *